10/22/85 XR 4,548,589

United States Patent [19]

Mayer et al.

[11] Patent Number: 4,548,589

[45] Date of Patent: Oct. 22, 1985

[54] ARC TUBE AND PLASTIC REFLECTOR ASSEMBLY METHOD

[75] Inventors: William Mayer; Alton E. Runions, Rochester, both of Ill.

[73] Assignee: Stewart-Warner Corporation, Chicago, Ill.

[21] Appl. No.: 392,332

[22] Filed: Jun. 28, 1982

[51] Int. Cl.[4] ..... H01J 9/32

[52] U.S. Cl. ..... 445/4; 156/293; 339/217 R; 445/22; 445/32

[58] Field of Search ..... 445/26, 27, 4, 3, 29, 445/32, 22, 23; 313/113; 29/837, 842, 844–845; 156/293, 294; 339/217 R; 362/267, 362

[56] References Cited

U.S. PATENT DOCUMENTS

| | | | |
|---|---|---|---|
| 2,644,100 | 6/1953 | Braunsdorff | 445/27 X |
| 2,685,072 | 7/1954 | Berman | 339/217 TP X |
| 2,892,923 | 6/1959 | Kuebler | 219/58 |
| 3,010,045 | 11/1961 | Plagge et al. | 313/113 |
| 3,281,923 | 11/1966 | Best et al. | 29/844 |
| 3,974,370 | 8/1976 | Pearson | 445/27 X |
| 4,180,755 | 12/1979 | Nixon, Jr. | 313/113 |
| 4,310,772 | 1/1982 | Tyler et al. | 313/113 |
| 4,414,613 | 11/1983 | Mayer | 362/267 |
| 4,425,100 | 1/1984 | Shiraishi et al. | 445/67 |

*Primary Examiner*—Kenneth J. Ramsey
*Attorney, Agent, or Firm*—A. G. Douvas

[57] ABSTRACT

A halogen bulb lamp assembly manufactured by mounting a previously aligned halogen bulb unit in a one-piece molded plastic rectangular reflector with a mirrorized paraboloidal inner surface. The halogen bulb unit has a pair of spaced connector pins that are coated with an epoxy adhesive and inserted into a pair of stepped through bores in the reflector. The pins are shaped to force epoxy uniformly into the larger portions of the reflector bores, and the ends of the pins project from the rear of the reflector and are spot welded to terminals that have barbed projections pressed into the rear of the reflector.

17 Claims, 14 Drawing Figures

Fig. 1.
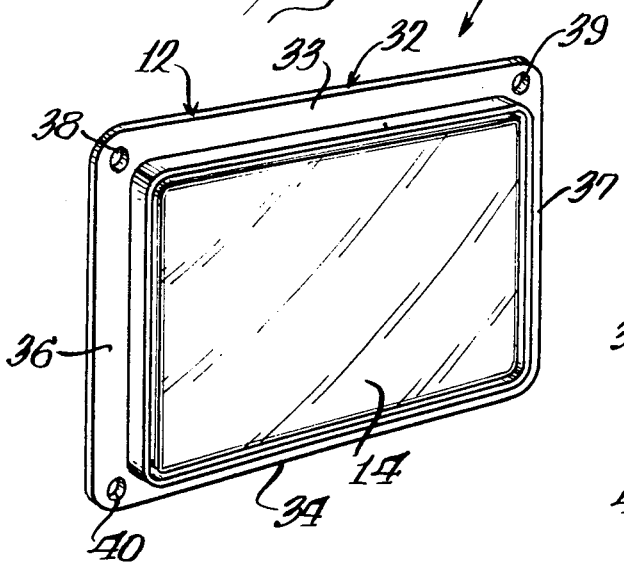
Fig. 2.
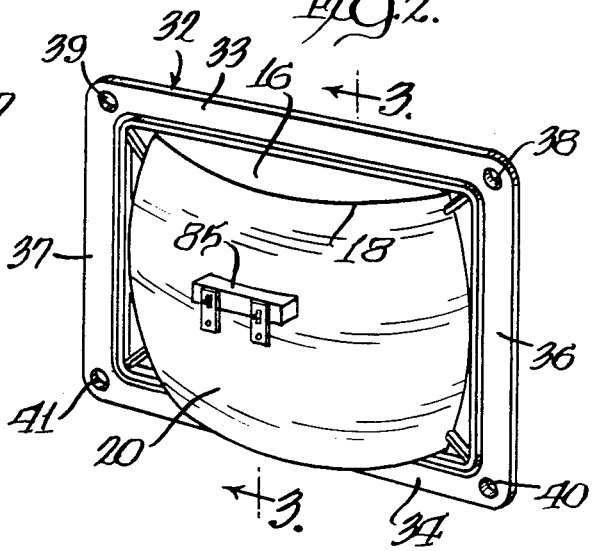
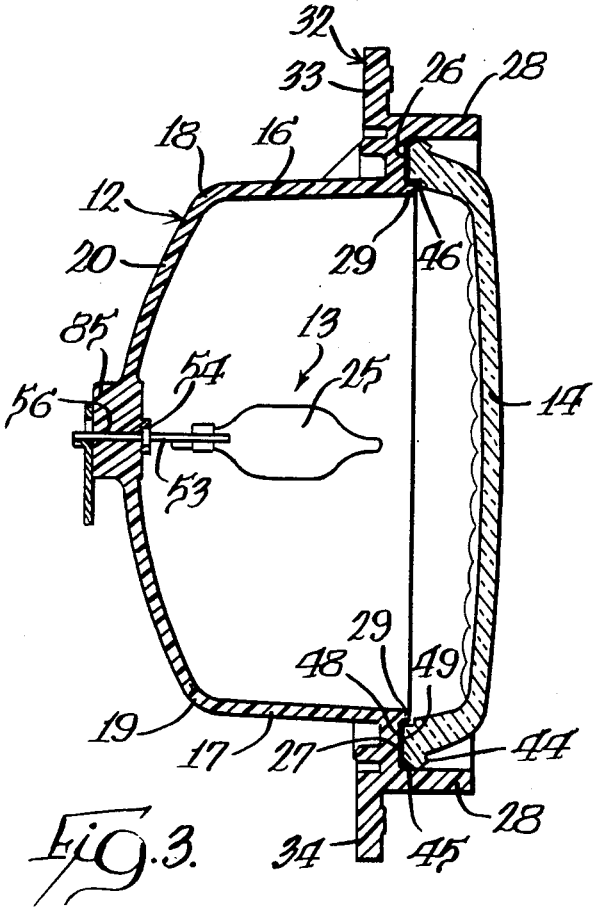
Fig. 3.
Fig. 10.
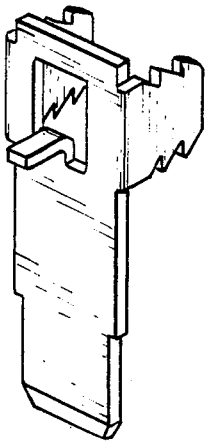

ARC TUBE AND PLASTIC REFLECTOR ASSEMBLY METHOD

BACKGROUND OF THE INVENTION

Vitreous glass sealed beam lamp units have been used for vehicle lighting since at least the 1930's in the United States. These lamps generally include a paraboloidal reflector having a highly mirrorized inner surface that usually has two central openings that receive connectors for a filament aligned within the reflector. The reflector is enclosed by a circular convex lens also constructed of glass that is located with respect to the reflector by various types of integral locating tabs and is joined to the reflector by heat fusion. The connector assemblies are also usually connected to the reflector by a heat fusion process, and the composition and pressure of gas within the reflector-lens envelope are carefully controlled through a filling tube formed integrally with the reflector, and this tube is fused after evacuation and/or, inert gas filling of the lamp envelope. Controlling the atmosphere within the envelope through the filling tube is extremely costly, and the filling tube must be carefully fused at the proper instant to achieve the desired atmosphere within the envelope.

Such a sealed beam lamp unit is shown and described in the D. K. Right U.S. Pat. No. 2,147,314 dated Feb. 21, 1939.

These sealed beam lamp units, which must be replaced after the filaments burn out, require complicated locking rings and adjustment assemblies, permanently carried by the associated vehicle to hold them in proper position. The locking rings frequently include adjusting brackets for varying the attitude of the lamp units to properly adjust the lamp's beam to effect the desired lamp alignment.

It has been suggested that the reflector of a rectangular sealed beam lamp unit be constructed of a plastic material with support flanges formed integrally with the plastic to eliminate the complicated mounting flanges and rings required in prior lamp units. Such a construction is shown in the Thomas T. Talon et al U.S. Pat. No. 4,188,655. This patent discloses a lamp with three integral flanges on a plastic reflector that cooperate with three adjusting assemblies mounted to the vehicle that permit adjustment of the lamp beam in two orthogonal planes. While such an arrangement is suitable for many passenger automobile applications it is nevertheless quite costly because of the three separate fastening and adjusting mechanisms required.

Another problem found in the manufacture of glass sealed beam lamp units is the difficulty in aligning the filament with the paraboloidal mirrorized reflector surface. Since the filament connector assembly is fused into the rear of the reflector, the fusion process itself frequently causes misalignment of the connector and the filament. Therefore, in sealed beam lamp units manufactured using this fusion technique it is necessary that the filaments be realigned after the fusion process has been completed. One attempt in the past to ameliorate this misalignment problem in vitreous glass lamp units has been to form the vitreous reflector with an enlarged opening in the rear and separately form a vitreous holder for the filament and connector assembly. The filament and connector assembly is then fused into the vitreous holder and the filament is aligned with respect to certain locating surfaces on the vitreous holder. Thereafter the holder and aligned filament are fused into the reflector. While this process has simplified the alignment of the filament it is also very costly because of the additional filament holder and the additional fusion of the holder to the reflector.

A still further problem in these vitreous lamp units is the difficulty in attaching the terminals to the rear of the vitreous reflectors. Heat fusion of the terminals is difficult and exacerbates the connector misalignment problem.

It is a primary object of the present invention to ameliorate the problems noted above in sealed beam lamp units.

SUMMARY OF THE PRESENT INVENTION

According to the present invention a halogen bulb lamp assembly is provided that has a molded plastic reflector and halogen bulb unit, that is far simpler to manufacture and less costly than prior known sealed beam lamp units of all types. Toward these ends, the halogen bulb lamp unit has connector pins with flanges that force epoxy adhesive uniformly around the ends of the pins in stepped mounting bores in the rear of the reflector and these flanges also locate the halogen bulb unit in the reflector as well as in a holder during alignment of the bulb.

The connector pins are spot welded to halogen bulb leads and one of the pins carries a strap that surrounds and holds the vitreous portion of the halogen bulb. The bulb itself is conventional and commercially available from a variety of manufacturers. The connector pins are parallel and the flanges are spaced substantially from the distal ends of the pins. The leading or distal ends of these pins have a diameter sized to give an interference fit with the smallest diameter portions of the stepped mounting bores in the rear of the reflector. This interference fit provides two functions. The snug fit holds the halogen bulb unit in proper alignment while the epoxy adhesive in the bores cures and secondly it wipes excess epoxy from the connector pins as they pass out the rear side of the reflector so that a clean surface is presented for terminal attachment.

Prior to assembly into the reflector, the halogen bulb unit subassembly is placed in an alignment fixture. This fixture has a pair of spaced holes that receive the ends of the connector pins and two sets of orthogonally aligned sight holes in the horizontal plane of the bulb's filament. The flanges on the connector pins accurately locate the pins in the fixture and the bulb is aligned by manually bending the pins until the filament is aligned in two transverse planes using the orthogonal sight holes.

After removal of the bulb unit from the alignment fixture, a portion of the distal ends of the connector pins is coated with a suitable epoxy adhesive and the pins are simultaneously inserted into the stepped mounting bores in the rear of the reflector. As the pins are pushed into these mounting bores, the flanges on the pins act as a piston pressing and forcing the epoxy adhesive into the larger portions of the bores completely and uniformly filling the open areas between the pins and the bores. The assembly is then heated sufficiently to cure the epoxy adhesive. This method assures that the halogen bulb unit will be permanently maintained in an aligned position and effectively seals the reflector envelope.

Terminals are electrically connected to the projecting ends of the connector pins and permit conventional vehicular electrical system connectors to be attached and detached quickly and easily. Each of these terminals has a tang portion insertable into the vehicular connector and an opening that receives the projecting end of connector pin. An L-shaped leg on the terminals extends in the same direction with and engages the lower surface of the pins and is spot welded thereto to assure good electrical contact.

The terminals have a pair of integral spaced barbed ears that fit in grooves in the rear of the reflector flanking the connector pins to lock the terminals in position. These ears permit the terminals to be easily attached to the reflector prior to bulb unit attachment and they hold the terminals in position against the ends of the connector pins during the spot welding operation.

BRIEF DESCRIPTION OF THE DRAWINGS

FIG. 1 is a perspective view of a rectangular sealed beam lamp assembly according to the present invention;

FIG. 2 is a rear perspective view of the sealed beam lamp assembly illustrated in FIG. 1;

FIG. 3 is an enlarged cross-section of the sealed beam lamp assembly taken generally along line 3—3 of FIG. 2;

FIG. 10 is a perspective view of one of the terminals;

DETAILED DESCRIPTION OF THE PREFERRED EMBODIMENT

Figure 4:
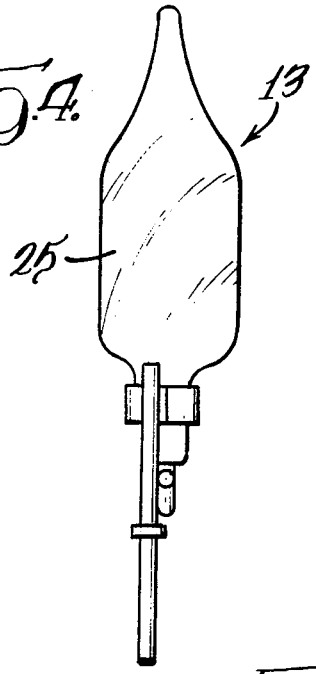
FIG. 4 is an enlarged side view of a halogen bulb unit according to the present invention.

Referring to the drawings and particularly FIGS. 1 to 3, a rectangular sealed beam halogen lamp assembly 10 is illustrated generally including a one-piece plastic reflector 12 with a halogen bulb unit 13 mounted therein and enclosed by a vitreous glass or plastic rectangular lens 14.

The reflector 12 is constructed entirely of a one-piece plastic molding of impact resistant plastic. One plastic that has been found to be particularly suitable is a polyester plastic "Petlon" manufactured by Mobay Chemical Company. This plastic is durable, shock resistant and also withstands a broad range of temperature variations.

Plastic reflector 12 includes generally flat top and bottom walls 16 and 17 having arcuate rear ends 18 and 19 connected together by a central paraboloidal wall 20. Interior surfaces 22 of walls 16, 17 and 20 are mirrorized by metallic vacuum deposition or other suitable process to provide the necessary reflective characteristics for the interior of the reflector to direct and focus light emitting from the halogen bulb 25 in bulb unit 13, forwardly along the geometric axis of the lamp unit through lens 14.

The forward end of the reflector 12 has a rectangular lens receiving recess 26 that is defined by outwardly extending integral wall 27, forwardly extending integral wall 28, and a rim 29 extending forwardly from walls 16, 17 and 20. Walls 27, 28 and rim 29 extend peripherally completely around the reflector 12. The wall 28 defines part of recess 26 and also forms a hood or shield around lens 14 to protect the lens and limit stray light emission from the lamp in a direction perpendicular to the axis of the lamp.

The lens 14 may be constructed of vitreous glass or plastic, either transparent or translucent, and is seen to have an outer peripheral rim 44 having a beveled rear surface 45 and an inner corner recess 46 that fits over and seals against the end of projecting rim 29. The position of recess 46 locates rear surface 48 of the reflector spaced slightly from the bottom surface of recess 26 to form a pocket with the beveled wall 45 in the recess for an epoxy adhesive 49 that extends all around recess 26.

A mounting flange 32 is formed integrally with walls 27 and 28 and includes straight parallel top and bottom portions 33 and 34 connected by straight parallel side portions 36 and 37 as seen clearly in FIG. 1. The mounting flange 32 has molded apertures 38, 39, 40 and 41 that receive conventional threaded fasteners for holding the entire lamp assembly to an outer panel of the associated vehicle.

Figure 5:
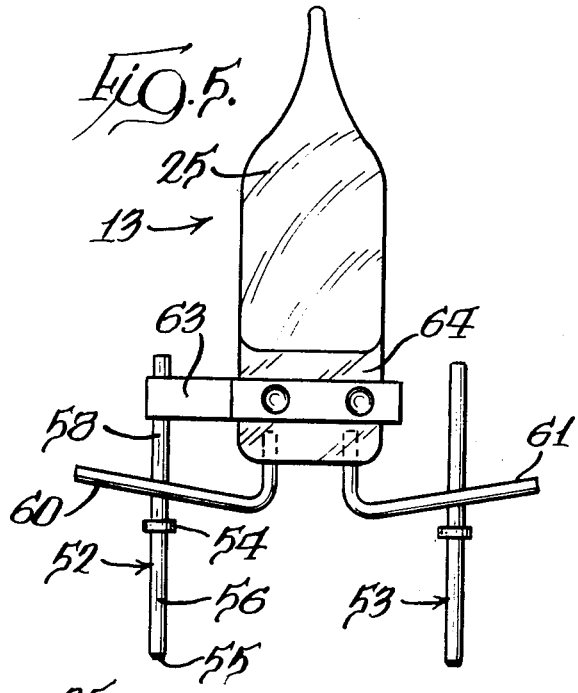
FIG. 5 is a front view of the halogen bulb unit illustrated in FIG. 4.
Figure 6:
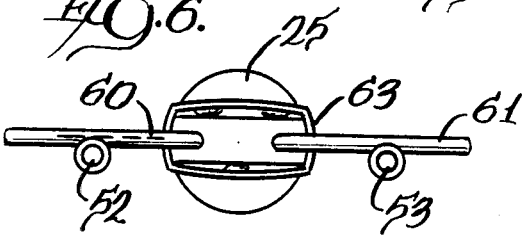
FIG. 6 is a bottom view of the halogen bulb unit illustrated in FIGS. 4 and 5.

As seen clearly in FIGS. 4 and 5, the halogen bulb unit 13 includes the halogen bulb 25 and a pair of identical spaced connector pins 52 and 53 each having an annular flange 54 spaced considerably from distal or leading pin end 55 and defining a pin end portion 56. The pins 52 and 53 are constructed of a suitable electrically conductive metal.

The upper portion 58 of each pin is spot welded to outwardly bent halogen bulb leads 60 and 61. Pin 52 has a bracket strap 63 welded adjacent its upper end that surrounds halogen bulb reduced base portion 64 and holds it in a fixed position with respect to the connector pins 52 and 53. With this assembly, the connector pins 52 and 53 define both the support for the bulb 25 and the conductive paths relative thereto.

The halogen bulb assembly 13 is optically aligned prior to assembly into the reflector 12. The filament 66 is aligned by properly spacing and aligning pins 52 and 53 and then bending bulb 25 until filament 66 is parallel to a plane extending through both pins 52 and 53 and is centered between the pins. To achieve this an alignment fixture 67 is provided that has a base 68 with spaced parallel bores 69 and 70 including enlarged upper counter-bores 72 that closely receive respectively the distal or leading pin portions 56 and the flanges 54. The flanges 54 serve as stops when seated in the counterbores 72.

The fixture 67 has opposed parallel planar walls 73 and 74 interconnected by perpendicularly related opposed parallel walls 75 and 76. Walls 73 and 74 have aligned rectangular horizontal elongated sight apertures 79 and 80 positioned at burner filament height level midway between the fixture bores 69 and 70, while walls 75 and 76 have aligned sight apertures 82 and 83 positioned on the desired axis of the filament 66 parallel to a plane extending through the axes of pins 52 and 53.

The reflector 12 has a rearwardly extending generally rectangular integral boss 85 as seen clearly in FIGS. 2 and 3. A pair of parallel aligned through bores 86 extend completely through boss 85 and are spaced apart the same distance as bores 69 and 70 in alignment fixture 67. As seen clearly in FIGS. 11, 12 and 13, the bores 86 are stepped including an upper counter-bore portion 88 that receives the connector pin flange 54, an upper enlarged cylindrical portion 89, an intermediate cylindrical portion 90 and a lower or outer reduced cylindrical portion 91. Cylindrical bore portion 91 has a diameter several thousandths of an inch smaller than the distal pin portion 56 so that there is an interference fit as the pin portion 56 is pushed through the reduced bore portion 91.

Figure 9:
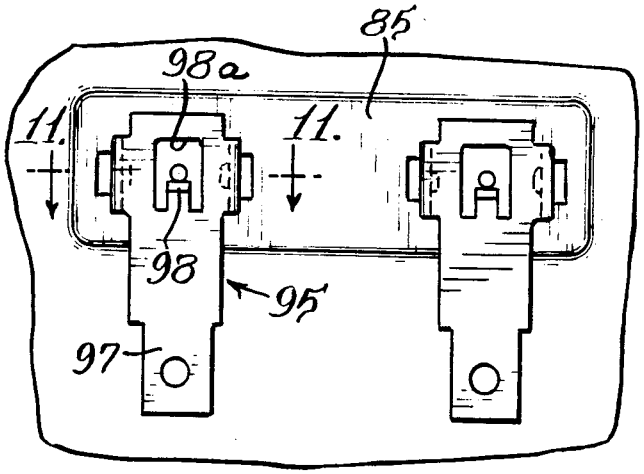
FIG. 9 is an enlarged fragmentary rear view of the lamp reflector illustrating the terminals.
Figure 14:
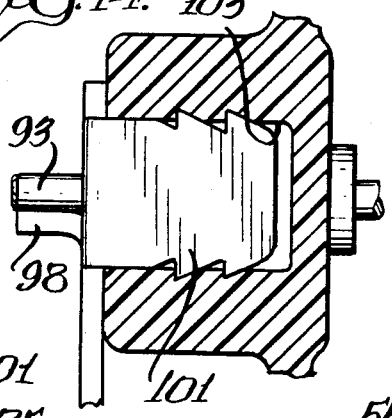
FIG. 14 is a fragmentary section taken generally along line 14—14 of FIG. 11 illustrating the interference fit of one of the barbed terminal ears in a groove in the rear side of the reflector.
Figure 11:
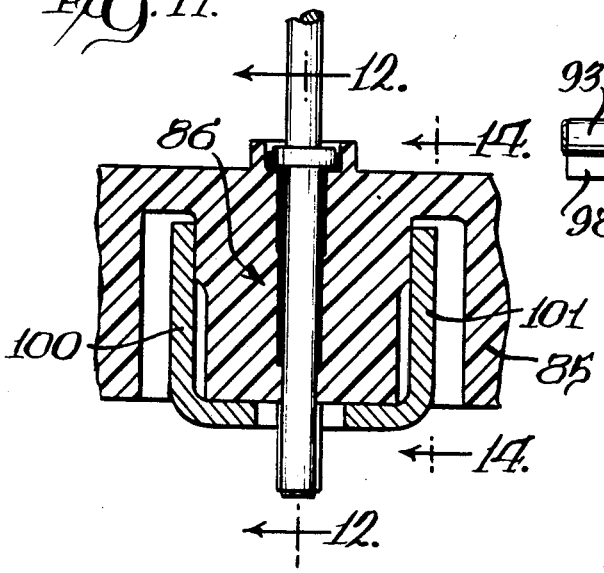
FIG. 11 is a fragmentary section taken generally along line 11—11 of FIG. 9 illustrating the connector pin attachment within one of the stepped reflector mounting bores.
Figure 12:
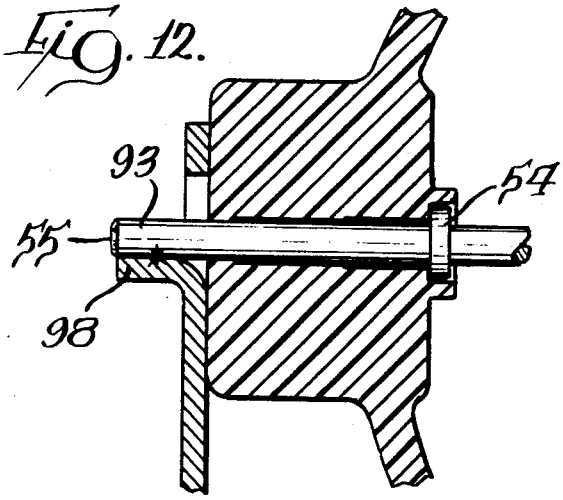
FIG. 12 is a fragmentary section taken generally along line 12—12 of FIG. 11 illustrating the terminal connection to one of the connector pins.

Connector terminals 95 are initially attached to the reflector 12. As seen clearly in FIGS. 9, 11 and 14, each of the terminals 95 is identical and includes a flat tang portion 97 with a rectangular opening 98*a* having an L-shaped tab 98 extending therein as seen in FIG. 12. Tab 98 has a portion parallel to and engageable with the bottom lower portion of the distal ends 93 of the connector pins 52 and 53 after they are attached to the reflector 12. Terminals 95 also have inwardly turned barbed ears 100 and 101 as seen in FIGS. 11 and 14 that have a width slightly greater than the width of grooves 103 molded in the rear surface of reflector boss 85. There are a pair of grooves 103 adjacent and flanking each of the reflector bores 86. The terminals 95 are pressed into the reflector 12 with the barbed ears 101 pushed into the interfering reflector grooves 103.

Figure 7:
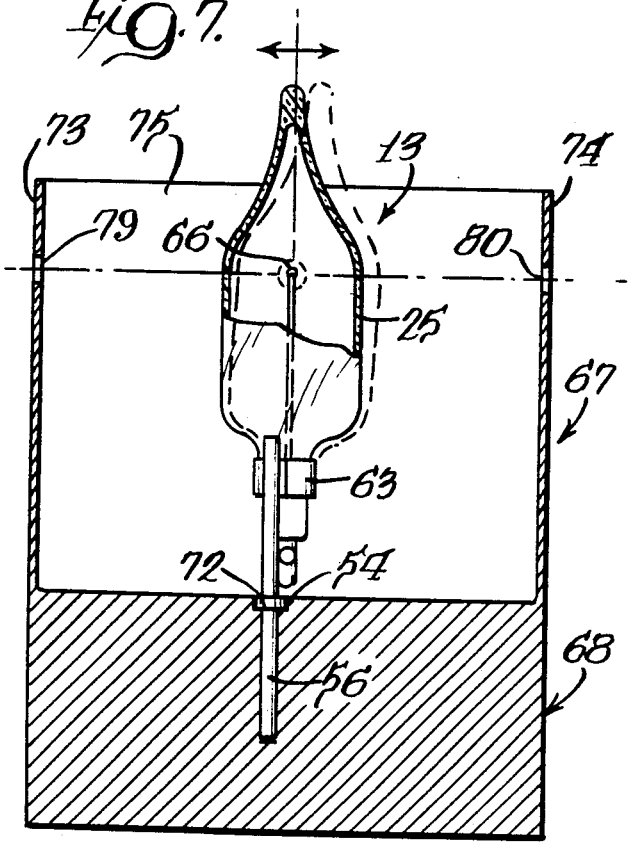
FIG. 7 is a cross-section of a halogen bulb alignment fixture according to the present invention with the halogen bulb unit illustrated in FIGS. 4 and 5 mounted therein.
Figure 8:
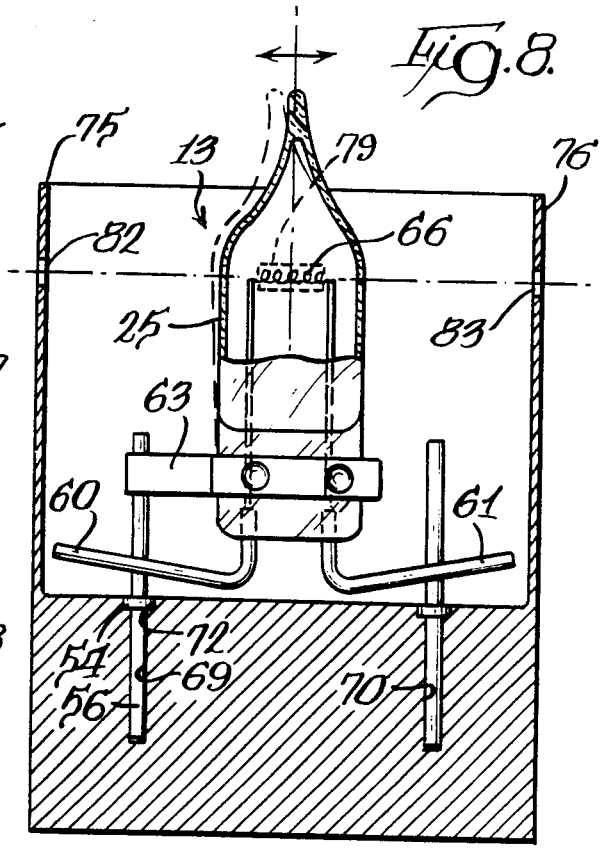
FIG. 8 is a longitudinal section of the alignment fixture illustrated in FIG. 7.

To effect alignment, the burner assembly 13 is placed in the fixture 67 by inserting lower rod portions 56 until flanges 54 are seated in counter-bore 72 and during this process the connecter pins are bent into parallelism with the flanges 54 of the pins being aligned in the same plane. Thereafter the pins are manually bent until the filament 66 is in optical alignment with the sight apertures 82 ad 83 in the plane of FIG. 7. Then using the line of sight apertures 79 and 80 the pins are bent in the plane of FIG. 8 centering the filament 66 midway between the bores 69 and 70. The aligned halogen bulb unit is then removed from the alignment fixture 67.

Figure 13:
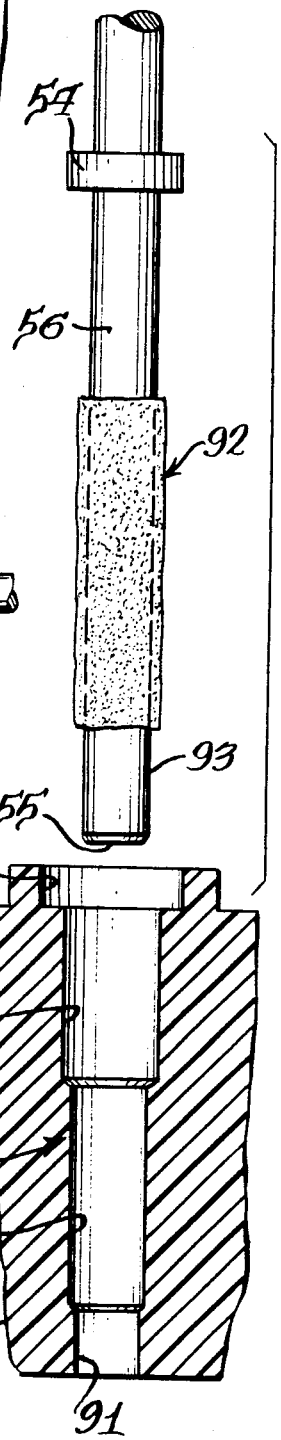
FIG. 13 is an exploded fragmentary view illustrating one of the connector pins coated with epoxy adhesive prior to insertion into one of the reflector mounting bores.

After the halogen bulb unit 13 is removed from the alignment fixture 67, an epoxy adhesive 92 is applied around the distal pin portion 56 of each pin spaced a short distance from pin end 55 as seen clearly in FIG. 13. The coated pins 52 and 53 carrying the halogen bulb unit are inserted into the bores 86 in the reflector 12. The terminals 95 have already been pressed into the rear of the reflector boss 85 and as the forward-most or distal "clean" portions 93 of the pins are pressed through reduced bore portion 91, the reduced bore portions begin wiping the epoxy from the pin portions 56 and pushing epoxy upwardly relatively to the pins toward the approaching pin flanges 54. In this way the reduced bore portions 91 clean epoxy adhesive from the portions of the pins projecting from the reflector as seen in FIG. 12 in engagement with terminal tabs 98, so that the terminals 95 may be welded thereto without further cleaning. The snug fit of the bores portions 91 with the pin portions 56 also serves to hold the entire bulb assembly 13 in an aligned position while the epoxy adhesive 92 is curing.

With continued movement of the pins into and through the bores 86, the pin flanges 54 as they approach bottoming in the counterbores 88, will engage the upper part of the epoxy adhesive 92 and act is pistons forcing epoxy uniformly throughout the enlarged intermediate bore portions 89 and 90 completely around the pin portions 56 thereby creating not only a good sealing bond but assuring accurate, secure alignment of the halogen bulb unit 13 in the reflector 12. After the flanges 54 hit the bottoms of the reflector counter-bores 88 the bulb unit 13 is correctly positioned in the reflector 12.

The tab 98 of each of the terminals is spot welded to the projecting and engaging pin portion 93. In this way the enlarged interfering barbed ears 101 hold the terminals securely in position while the connector pins are being spot welded thereto without any additional holding fixture or support, and of course they continue to firmly hold the terminals to the reflector after welding.

The lens 14 is then attached with epoxy 49 to the reflector recess 26 and the assembly is baked for approximately 90 minutes at 320 degrees Fahrenheit to cure the epoxy adhesive around pins 52 and 53 as well as around the lens 14. Subsequent to baking, a vent hole, not shown in the drawing, in the rear of the reflector 12, is sealed with a vent plug as shown and described fully in our copending application Ser. No. 376,619, filed May 10, 1982, assigned to the assignee of the present invention.

We claim:

1. A method of making a lamp assembly with a halogen bulb unit and a plastic reflector including the steps of; forming the plastic reflector with a centrally positioned boss having two spaced bores therein, attaching two spaced connector pins to the halogen bulb unit with each of the pins having a flange spaced substantially from the distal end thereof, applying an adhesive to the pins near the distal ends thereof, and connecting the bulb unit to the reflector by inserting the distal ends of the connector pins into the reflector boss bores forcing the adhesive uniformly into the bores with the connector pin flanges.

2. A method of making a lamp assembly with a halogen bulb unit and a plastic reflector as defined in claim 1, including the step of aligning the halogen bulb with respect to the axes of the connector pins prior to inserting the connector pins into the reflector boss bores.

3. A method of making a lamp assembly with a halogen bulb unit and a plastic reflector as defined in claim 1, including the step of forming each of the reflector boss bores with a first enlarged diameter portion adjacent the inner surface of the reflector and a second reduced diameter portion adjacent the rear of the reflector boss, said reduced diameter bore portion have a diameter slightly less than the diameter of the distal ends of the connector pins so that as the pins are being inserted into the bores the reduced diameter bore portions will wipe away excess adhesive from the pins and hold the bulb unit in proper position until the adhesive sets.

4. A method of making a lamp assembly with a halogen bulb unit and a plastic reflector as defined in claim 1, wherein the reflector boss bores are formed completely through the reflector, the step of inserting the connector pins including inserting the connector pins into the boss bores so they project from the rear side of the reflector boss, and forming terminals with mounting projections and attaching the terminals to the reflector by inserting the terminal projections into the rear of the reflector boss adjacent to the boss bores.

5. A method of making a lamp assembly with a halogen bulb unit mounted in a mirrorized plastic reflector, including the steps of; forming a plastic reflector with a paraboloidal reflective surface and two parallel spaced bores extending through the reflector substantially centrally of the paraboloidal surface, each of the bores having an enlarged diameter portion adjacent the reflective surface and a reduced diameter portion adjacent the rear of the reflector, forming a pair of connector pins and attaching them to the halogen bulb unit with each of the pins having an end portion with a diameter substantially the same as the reduced diameter bore portions, applying an adhesive near the end portion of each of the pins, and connecting the halogen bulb unit to the reflector by inserting the connector pins into the bores with the pin end portions sliding through the reduced diameter bore portions to wipe away excess adhesive and to hold the pins rigidly in position while the adhesive sets.

6. A method of making a lamp assembly with a halogen bulb unit mounted in a mirrorized plastic reflector, including the steps of; forming a plastic reflector with a paraboloidal reflective surface and two parallel spaced bores extending through the reflector substantially centrally of the paraboloidal surface, each of the bores having an enlarged diameter portion adjacent the reflective surface and a reduced diameter portion adjacent the rear of the reflector, forming a pair of connector pins and attaching them to the halogen bulb unit with each of the pins having an end portion with a diameter substantially the same as the reduced diameter bore portions and with each of the pins having a flange at the proximal end of the pin end portion, applying an epoxy adhesive to the pin end portions, inserting the pins into the bores until the pin flanges engage the reflector, and heating the lamp assembly until the epoxy cures thereby connecting the halogen lamp unit firmly to the reflector.

7. A method of making a lamp assembly with a halogen bulb unit and a plastic reflector as defined in claim 6, wherein the reduced diameter portions of the bores are formed with diameters slightly less than the diameter of the end portions of the connector pins so that the reduced bore portions wipe away excess epoxy from the pins.

8. A method of making a lamp assembly with a halogen bulb unit and a plastic reflector as defined in claim 6, including the step of aligning the halogen bulb with respect to the axes of the pins prior to connecting the halogen bulb unit to the reflector.

9. A method of making a lamp assembly with a halogen bulb unit and a plastic reflector as defined in claim 6, wherein the reflector bores are formed completely through the reflector, the step of inserting the connector pins including inserting the connector pins into the bores so they project from the rear side of the reflector, forming terminals with mounting projections and attaching the terminals to the reflector by inserting the terminal projections into the rear of the reflector adjacent to the reflector bores prior to insertion of the connector pins.

10. A method of making a lamp unit having a mirrorized plastic reflector with a halogen bulb unit mounted therein, including the steps of; forming the plastic reflector with a pair of spaced bores therein, forming a pair of connector pins and attaching them to the halogen bulb unit, inserting the pins in a holder that positions the pins coaxially with two lines spacially related in the same way as the reflector bore centerlines, aligning the attached halogen bulb in the holder with respect to the axes of the pins and hence the reflector bore centerlines, and attaching the bulb unit to the reflector by inserting the connector pins into the reflector bores whereby the halogen bulb unit is aligned with the reflector.

11. A method of making a lamp assembly with a halogen bulb unit and a plastic reflector as defined in claim 10, including the step of applying epoxy adhesive to the connector pins prior to insertion into the reflector bores, and heating the lamp assembly after inserting the connector pins into the reflector bores at a temperature and for a time sufficient to cure the epoxy adhesive.

12. A method of making a lamp assembly with a halogen bulb unit and a plastic reflector as defined in claim 10, including the step of forming the pins with a flange spaced from the distal ends thereof, the flange defining a stop for the pins during insertion into both the holder and the bores in the reflector.

13. A method of making a lamp assembly with a mirrorized plastic reflector and a halogen bulb unit, including the steps of, forming a plastic reflector with a pair of spaced parallel bores therein, forming a pair of connector pins each with an end portion having a diameter substantially the same as a portion of the bores in the reflector and with a flange spaced substantially from the end thereof, attaching the pins to a halogen bulb, placing the pins in a holder and bending the halogen bulb or pins to align the bulb, applying an adhesive to the pin end portions, and thereafter inserting the pins into the reflector bores with adhesive entering the bores and with the pins in the bore end portions so the bulb unit is held rigidly in an aligned position while the adhesive sets.

14. A method of making a lamp assembly with a halogen bulb unit and a plastic reflector as defined in claim 13, wherein the step of inserting the pins into the reflector bores includes the step of inserting the pins sufficiently so that the flanges on the pins force adhesive into the reflector bores until the flanges engage the reflector, and welding terminals to the ends of the connector pins.

15. A method of making a lamp unit with a mirrorized plastic reflector and a halogen bulb unit, the steps including, forming a plastic reflector with a mirrorized paraboloidal inner surface and at least two bores extending therethrough and at least one groove on the outside of the reflector adjacent each of the bores, forming a pair of terminals each with a projection extending generally transverse to the terminals and sized somewhat larger than the reflector grooves and with an integral tab generally adjacent the terminal projection, connecting each terminal to the reflector by pressing the terminal projection into one of the reflector grooves, forming a halogen bulb unit having two connector pins extending therefrom, connecting the bulb unit to the reflector by inserting the bulb unit connector pins into the reflector bores, said reflector grooves being positioned to hold the tab in engagement with the connector pins prior to and during bonding, and thereafter bonding the connector pins directly to the tabs.

16. A method of making a lamp assembly with a halogen bulb unit and a plastic reflector as defined in claim 15, wherein the step of forming the terminals includes forming each of the terminals with two barbed projections on either side of an aperture therein, said step of forming the reflector including forming the reflector with a groove on each side of each of the bores sized smaller than the barbed projections on the terminals, the step of connecting the terminals to the reflector including pushing the barbed projections into the reflector grooves on either side of the reflector bores, and spot welding each of the terminals to the adjacent connector pin.

17. A method of making a lamp unit with a mirrorized plastic reflector and a halogen bulb unit, including the steps of, forming the reflector with a mirrorized surface and a pair of through bores with at least one exterior groove adjacent each of the bores, forming a pair of terminals each with an aperture and a projection, placing the aperture of each terminal over one of the reflector bores and pushing the projection into the adjacent groove in the reflector, forming a halogen bulb assembly with at least two spaced parallel connector pins having flanges spaced from the distal ends thereof, placing the connector pins in a holder and aligning the halogen bulb assembly, applying an epoxy adhesive to the pins between the flanges and the ends thereof, connecting the aligned bulb unit in the reflector by inserting the epoxy coated pin ends into the reflector bores so that the flanges force epoxy into the bores and the ends of the pins project from the reflector into the terminal apertures, and heating the reflector and connected halogen bulb unit sufficiently to cure the epoxy adhesive.

* * * * *